US009959846B1

(12) United States Patent
Landon et al.

(10) Patent No.: US 9,959,846 B1
(45) Date of Patent: May 1, 2018

(54) METAL FROG FOR A VIOLIN BOW

(71) Applicants: Christophe Landon, New York, NY (US); Adrian Landon, New York, NY (US)

(72) Inventors: Christophe Landon, New York, NY (US); Adrian Landon, New York, NY (US)

( * ) Notice: Subject to any disclaimer, the term of this patent is extended or adjusted under 35 U.S.C. 154(b) by 0 days. days.

(21) Appl. No.: 15/615,265

(22) Filed: Jun. 6, 2017

(51) Int. Cl.
*G10D 3/16* (2006.01)

(52) U.S. Cl.
CPC ..... *G10D 3/16* (2013.01)

(58) Field of Classification Search
CPC ..... G10D 3/16
See application file for complete search history.

(56) References Cited

U.S. PATENT DOCUMENTS 2,252,929 A 8/1941 Heddon
2,466,168 A * 4/1949 Graydon ..... G10D 3/16 261/69.2
3,981,219 A 9/1976 Johns
4,020,731 A 5/1977 Darling
4,040,322 A 8/1977 Parkyns et al.
4,493,238 A 1/1985 Ricci
4,713,998 A 12/1987 Weiss
5,783,762 A 7/1998 Lindauer
7,166,787 B2 1/2007 Rand
8,168,871 B1 5/2012 Sweedler
8,273,973 B2 9/2012 Kimmons et al.

* cited by examiner

*Primary Examiner* — Kimberly Lockett
(74) *Attorney, Agent, or Firm* — Pearl Cohen Zedek Latzer Baratz LLP

(57) ABSTRACT

A frog for a stringed instrument bow is disclosed which has a hollow metal body, which may be made, for example, of direct laser metal sintered titanium. The hollow body has a top side adapted to engage a bow stick of the stringed instrument bow, and a bottom side adapted to support a hair bundle of the stringed instrument bow. A back stop is positioned proximate the bottom side in the interior of the hollow metal body and a cam attached to the bottom side of the hollow metal body is adapted to slide or rotate with respect to the hollow metal body, from an open position in which a hair bundle can be inserted in the hollow metal body and a closed position in which the cam forms a pinch point with the back stop to secure the hair bundle.

11 Claims, 4 Drawing Sheets

METAL FROG FOR A VIOLIN BOW

BACKGROUND OF THE INVENTION

Field of the Invention

The invention is directed to a metal frog for a stringed instrument bow, such as a violin or cello bow. The invention is also directed to a hair lock mechanism which may be used with the frog according to the invention, or retrofitted to an existing bow. The metal frog, including the novel hair lock mechanism, has a unique appearance and delivers excellent sound quality, and significantly simplifies the making and use of the bow.

Description of the Prior Art

A conventional solid ebony frog is provided with a cavity, called the mortise, carved into the bottom side of the frog. To install the hair of the bow, the mortise receives a hair bundle, a wooden plug is glued in place over the hair bundle in the mortise, and an underslide is slid into place over the opening of the cavity and secured in place with a ferrule. Carving the mortise is a tedious process, as ebony is prone to failure. Fitting the ferrule likewise requires very precise work, with the result that changing the hair bundle of a stringed instrument how is a tedious process which can only be done by an expert.

Import/export restrictions on ivory and on a rare and endangered wood species have made travel with fine bows difficult. Even small amounts of these materials on a violin bow may cause the object to be seized by customs.

SUMMARY OF THE INVENTION

Thus, an object of the invention is to provide means to secure a hair bundle to a frog without using a mortise, plug or glue. A further object of the invention is to provide a thin-walled, hollow, metal frog with precise dimensions, capable of having fine lattice metalwork in titanium as ornamentation.

Another object of the invention is to provide a high-quality frog that can be made reliably and reproducibly, which avoids the use of ivory and rare and endangered wood species, and which can be installed on an existing bow to replace ivory or endangered species parts, so that the bow may be transported without negatively impacting quality.

These and other objects of the invention are achieved according to one aspect of the invention with a unique frog for a stringed instrument bow, comprising: a hollow metal body having a top side adapted to engage a bow stick of the stringed instrument bow, and a bottom side adapted to support a hair bundle of the stringed instrument bow. According to the invention, a back stop is provided in a fixed position proximate the bottom side of the frog in the interior of the hollow metal body (and preferably formed as a single piece with the hollow metal body). A cam attached to the bottom side of the hollow metal body, near the back stop, is adapted to slide or rotate with respect to the hollow metal body, from an open position in which a hair bundle can be inserted in the hollow metal body and a closed position in which the cam forms a pinch point with the back stop to secure a hair bundle. An underslide is received over the cam in the closed position and may be secured by a ferrule, as known in the art.

The frog is preferably made using direct laser metal sintering, so that the frog can be made entirely of metal, such as titanium or titanium alloy, and may include lattice-work on the side walls enclosing the hollow interior of the frog. Alternatively, the side-walls may be solid.

In a specific embodiment, the cam is a rotating lever. In this embodiment, the frog comprises a hollow metal body having a top side adapted to engage a bow stick of the stringed instrument bow, and a bottom side adapted to support a hair bundle of the stringed instrument bow. A back stop, which may be formed as a single piece with the metal body, is provided in a fixed position proximate the bottom side of the frog in the interior of the hollow metal body. A lever attached to a pivot point proximate the bottom side of the hollow metal body is adapted to rotate about the pivot point, from an open position in which one end of the lever is inside the hollow metal body to a closed position, in which the lever is aligned with the bottom side of the hollow body and one end of the lever forms a pinch point with the back stop, adapted to secure a hair bundle of the bow. An underslide is received over the bottom side of the frog and a ferrule may be received over the underside to secure the underslide in place.

In another aspect, the invention is directed to the hair-lock element, independently of the material of the body of the frog. In this aspect, a hair lock according to the invention comprises a back stop in a cavity of the frog, proximate a bottom side of the frog and a lever attached to the frog at a pivot point, proximate the bottom side of the frog, adapted to rotate about the pivot point, from an open position in which one end of the lever is inside the frog, and a closed position in which the lever is aligned with the bottom side of the frog and one end of the lever forms a pinch point with the back stop adapted to secure a hair bundle between the lever and the back stop.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

DETAILED DESCRIPTION OF THE PRESENT INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

Dimensions herein are provided for illustration only and do not limit the invention. However, existing violin and cello bows and sizes are near-standard and outer dimensions of the frog are generally consistent with those used in the art for conventional wooden frogs. For example only, and not by way of limitation, a frog may have a height of about 24 mm from top to bottom, a length of about 50 mm and concave walls tapering from a bottom side having a width of about 14.5 min to a top side having a width of about 9.5 mm, with the narrowest portion being between the top side and the bottom side. Unless the context clearly requires otherwise, when dimensions or other values are modified by the word "about", this refers to a variation of no more than ±20%. Likewise, "substantially", "substantially all" and similar variations, means no less than 90%, unless the context clearly requires otherwise.

Figure 1:
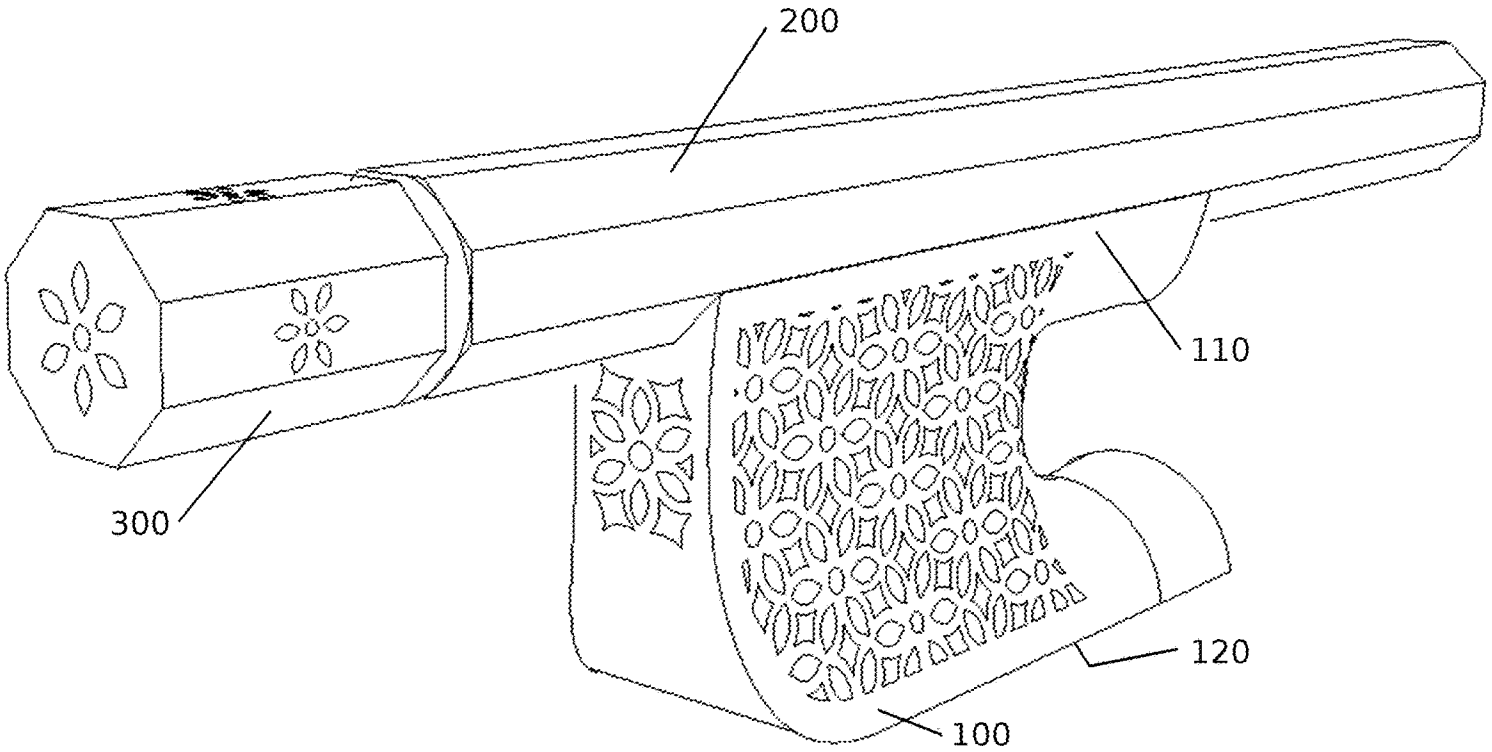
FIG. 1 is a perspective view of a frog according to embodiments of the invention without the hair, and with a partial view of the bow stick and button.
Figure 4A:
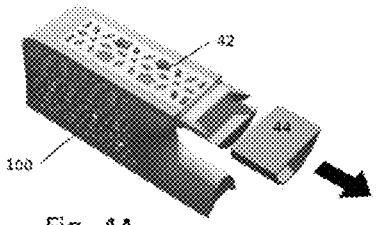
FIGS. 4A-4C show a view from the bottom side of a frog according to embodiments of the invention.
Figure 4B:
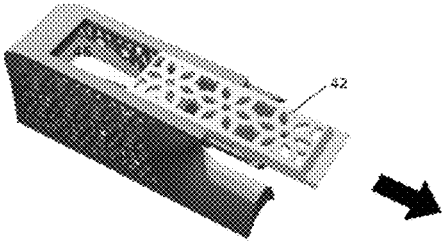
Figure 4C:
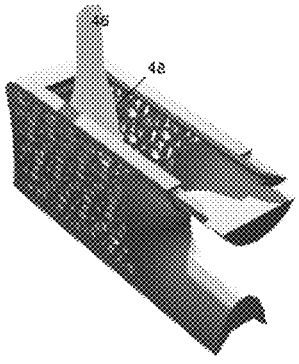

As shown in FIG. 1, frog 100 according to the invention includes a top side 110 receiving the bow stick 200, and a bottom side 120. As known in the art, a metal button 300 having a screw (not shown) extends into the bow stick from the rear side of the frog and may be rotated to adjust the tension of the hair of the bow, once installed. FIGS. 4A through 4C show views from the bottom side 120 of the frog 100. Removing ferrule 44 and underslide 42, as shown in FIGS. 4B and 4C, reveals the hollow interior of the frog. Hollow, in this context, means thin-walled, and not merely drilled out or having a cavity. While not critical, the thickness of the transverse walls may be in a range of about 1-2 mm. In embodiments, the transverse walls, and even the rear wall, have ornamental lattice work, preferably in titanium. Apart from being beautiful and novel in this context, the metalwork may reduce the weight of the metal frog and improve the feel and grip. The openings of the lattice may also disguise the attachment of a cam member, such as a lever, to the hollow body. Once the hair bundle (not shown in FIG. 1) is installed on the bow, the underslide 42 and ferrule 44 may be installed to secure the hair bundle and spread the fibers evenly across the width of the frog.

As would be understood by a person of ordinary skill in this art, the thin walls of the frog, including the shape of the intricate lattice patterns, cannot be obtained using conventional metal working, but only with direct laser metal sintering (DLMS), in which powered metal is used as the starting material and an object is built up in programmed layers based on a computer aided design (CAD) file. Thus, according to embodiments of the invention, the hollow metal body, including the backstop is a single piece of direct laser sintered metal. Titanium, aluminum and their alloys are suitable for DLMS manufacture according to the invention. Titanium in particular has been used successfully with DLMS to make a frog according to the invention, having exceptional beauty and finish. The sound achieved is variously described as "bright" and "fast". A thin-walled hollow metal frog has not been found or described in the prior art.

A "cam", as that term is used herein, refers broadly to any mechanical member that is moved into place to squeeze a hair bundle in the interior space of the frog. In some instances, the cam may directly slide into or be rotated into such squeezing relationship, in other instances, a lever may be provided with a force multiplying member, so that the element contacting the hair bundle is distinct from the element moved by the user to secure the hair bundle.

In the embodiment shown, the cam member consists of lever 46 attached to the hollow metal body 100 at a pivot point 48. The cam member may be shaped differently without departing from the scope of the invention, provided that a hair bundle may be inserted into a space 31 in the hollow metal body (shown in FIG. 3C) and secured in a closed position (pinch point) between the back stop and the cam member. Although lever 46 rotates into a closed position in the embodiment shown, the hollow body may also be provided with slots so that a cam member translates between an open position and a closed position.

Figure 2A:
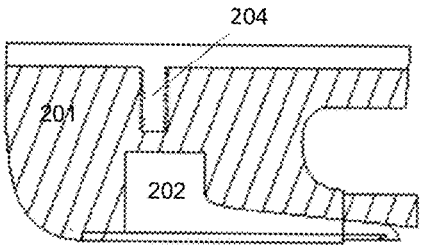
Fig. 2A (Prior Art)
FIG. 2A-2D depict a solid ebony frog with a plug installation of the hair bundle, as practiced in the prior art.
Figure 2B:
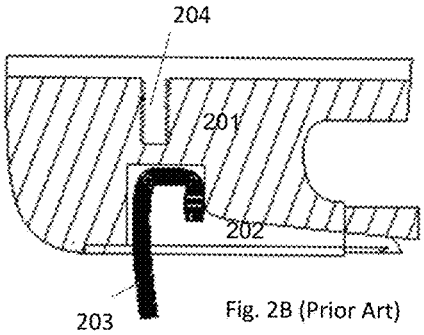
Fig. 2B (Prior Art)
Figure 2C:
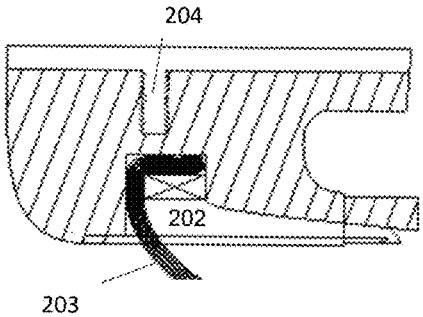
Fig. 2C (Prior Art)
Figure 2D:
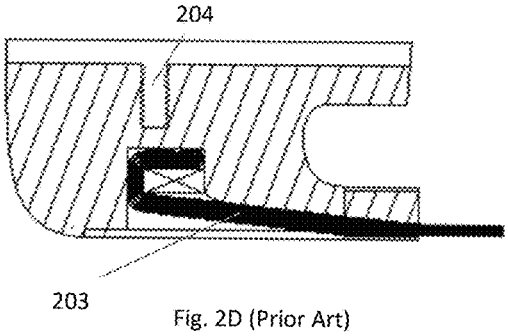
Fig. 2D (Prior Art)

The advantages of the claimed invention may be seen by comparing the prior art solid ebony frog and the process of using it depicted in FIGS. 2A through 2D, and the use of a hollow frog with a hair lock as presently claimed and described in FIGS. 3A through 3D. FIG. 2A depicts a solid ebony frog 201 according to the prior art, having a carved-out mortise 202. (Threaded opening 204 receives an eyelet to engage the button, which is not involved until after the hair is installed). To install the hair, a hair bundle 203 is placed in the cavity. Note that the hair bundle must be the appropriate length to be completely received in the cavity. Thereafter, plug 208 is glued in place and, as shown in FIGS. 2C and 2D, the hair bundle is stretched over the bottom of the frog.

Figure 3A:
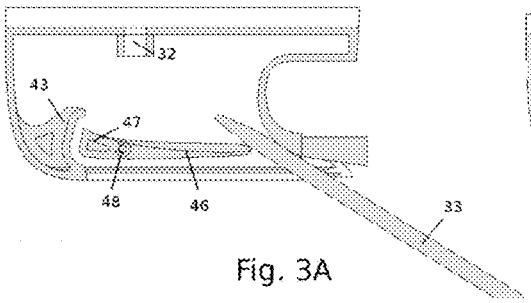
FIGS. 3A-3D are schematic side cutaway views showing installation of a hair bundle in a frog according to embodiments of the invention.
Figure 3B:
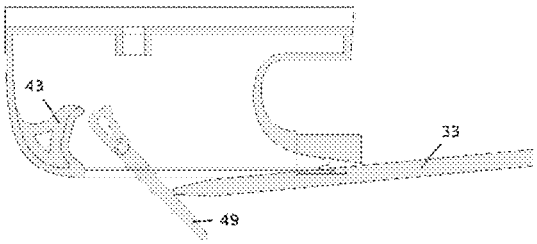
Figure 3C:
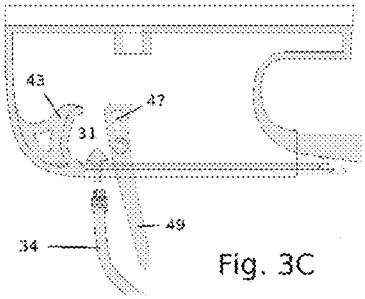
Figure 3D:
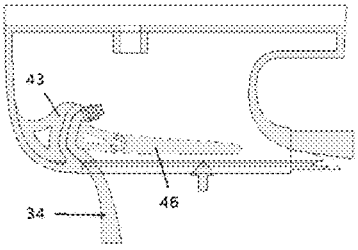

To install a hair bundle using a frog according to embodiments of the invention, the user removes the ferrule 44 and underslide 42 from the frog revealing a hollow interior of the frog and a lever 46 (shown in FIGS. 4A through 4C). As shown in FIG. 3A, a small flat head implement 33 (such as a small flat-head screwdriver) is inserted on one side of the lever 46 and the lever is pried open, so that the head end 47 of the lever 46 is rotated into the interior of the frog. A hair bundle 34 is secured in the space 31 between the head end of the lever and a back stop 43 in the interior of the frog. The user then rotates the lever, so that the lever aligns with the bottom of the frog and locks the hair in a pinch point formed between the lever head end 47 and the backstop 43. The underslide 42 and ferrule 44 are replaced, and the button 300 is used to tighten the hair, as in the prior art.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention. Further, the embodiments disclosed herein are related, so that features and dependent limitations disclosed in the specification in connection with one embodiment or one independent claim may also be combined with another embodiment or another independent claim, without departing from the scope of the invention.

What is claimed is:

1. A frog for a stringed instrument bow, comprising:

a hollow metal body having an interior and having a top side adapted to engage a bow stick of the stringed instrument bow, and a bottom side adapted to support a hair bundle of the stringed instrument bow;

a back stop in a fixed position proximate the bottom side in the interior of the hollow metal body;

a cam attached to the bottom side of the hollow metal body, adapted to slide or rotate with respect to the hollow metal body, from an open position in which a hair bundle can be inserted in the hollow metal body and a closed position in which the cam forms a pinch point with the back stop to secure a hair bundle;

an underslide received over the cam in the closed position; and a ferrule and securing the underslide to the bottom side of the frog.

2. A frog according to claim 1, having two major opposed sides having weight reduction openings in a lattice pattern.

3. A frog according to claim 2, wherein the two major opposed sides are concave.

4. A frog according to claim 1, wherein the hollow metal body is formed from a single piece of direct laser sintered metal.

5. A frog according to claim 1, wherein the hollow metal body and the back stop are a single piece formed by direct laser sintered titanium.

6. A frog according to claim 2, wherein the major opposed sides have a wall thickness of 1-2 mm.

7. A frog for a stringed instrument bow, comprising:

a hollow metal body having an interior and having a top side adapted to engage a bow stick of the stringed instrument bow, and a bottom side adapted to support a hair bundle of the stringed instrument bow;

a back stop in a fixed position proximate the bottom side in the interior of the hollow metal body;

a lever attached to a pivot point proximate the bottom side of the hollow metal body, adapted to rotate about the pivot point, from an open position in which one end of the lever is inside the hollow metal body and a closed position in which the lever is aligned with the bottom side of the hollow body and one end of the lever forms a pinch point with the back stop adapted to secure a hair bundle;

an underslide received over the lever; and a ferrule received over the underslide.

8. A hair lock for a frog of a stringed instrument bow, the frog having an interior cavity, a top side adapted to engage a bow stick of the stringed instrument bow, and a bottom side adapted to support a hair bundle of the stringed instrument bow, the hair lock comprising:

a back stop in the cavity of the frog, proximate a bottom side of the frog;

a lever attached to the frog at a pivot point, proximate the bottom side of the frog, the lever being adapted to rotate about the pivot point, from an open position in which one end of the lever is inside the frog, and a closed position in which the lever is aligned with the bottom side of the frog and one end of the lever forms a pinch point with the back stop adapted to secure a hair bundle between the lever and the back stop, and further comprising an underslide covering the cavity and a ferrule clamping the underslide to the frog.

9. The hair lock according to claim 8, wherein the frog is direct laser sintered metal.

10. The hair lock according to claim 8, wherein the backstop and the frog consist of a single integral piece of wood or metal.

11. The hair lock according to claim 8, wherein the frog is made of wood.

* * * * *